US008863401B2

(12) United States Patent
Grunert et al.

(10) Patent No.: US 8,863,401 B2
(45) Date of Patent: Oct. 21, 2014

(54) HOUSEHOLD LAUNDRY DRYER CONDENSATE FILTERING APPARATUS AND METHOD

(75) Inventors: Klaus Grunert, Berlin Reinickendorf (DE); Frank Kohlrusch, Berlin (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 174 days.

(21) Appl. No.: 13/263,163

(22) PCT Filed: Apr. 15, 2010

(86) PCT No.: PCT/EP2010/054944
§ 371 (c)(1),
(2), (4) Date: Oct. 6, 2011

(87) PCT Pub. No.: WO2010/121942
PCT Pub. Date: Oct. 28, 2010

(65) Prior Publication Data

US 2012/0024801 A1 Feb. 2, 2012

(30) Foreign Application Priority Data

Apr. 21, 2009 (DE) ..... 10 2009 002 540

(51) Int. Cl.
*D06F 58/22* (2006.01)
*D06F 58/24* (2006.01)

(52) U.S. Cl.
CPC ..... *D06F 58/24* (2013.01); *D06F 58/22* (2013.01)
USPC ..... 34/90; 210/791

(58) Field of Classification Search
USPC ..... 210/97, 106, 108, 121, 123, 130, 210/167.01, 321.6, 321.69, 321.84, 354, 210/355, 409, 411, 459, 791, 800, 801; 8/158; 34/69, 82, 90
See application file for complete search history.

(56) References Cited

U.S. PATENT DOCUMENTS 3,066,519 A 12/1962 Boswinkle et al.
3,543,542 A 12/1970 Bochan (Continued)

FOREIGN PATENT DOCUMENTS

DE 102006018469 * 4/2006 ..... D06F 58/20
DE 102006018469 A1 10/2007

(Continued)

OTHER PUBLICATIONS

Lare Luft und Kaltetechni, "Temperature and Pressure Equalization of Heat Exchangers in Laundry Driers and Similar Heat Pump Systems," 2006, English Translation of DE102006018469.*

(Continued)

*Primary Examiner* — Bobby Ramdhanie
*Assistant Examiner* — Patrick Orme
(74) *Attorney, Agent, or Firm* — Nixon & Vanderhye, P.C.

(57) ABSTRACT

A household laundry dryer has at least one filter container which includes a chamber with an inlet for condensate water to be cleaned. The chamber has a first outlet, a second outlet and a filter element which is arranged between the inlet and the first outlet and which divides the chamber into an inlet-side first chamber part and a second chamber part. The filter container can be configured in such a way that the inlet is arranged below the filter element and the filter element is arranged below the first outlet, and the second outlet opens into the first chamber part. Particles deposited on the filter element by water being pushed through the inlet into the chamber are detachable from the filter element by water flowing back into the chamber, when no water is being pushed through the inlet, and removable through the second outlet.

28 Claims, 5 Drawing Sheets

(56) References Cited

U.S. PATENT DOCUMENTS

| | | | | |
|---|---|---|---|---|
| 3,681,947 | A | 8/1972 | Cowan | |
| 3,727,435 | A * | 4/1973 | Menk | 68/18 F |
| 5,478,484 | A | 12/1995 | Michaluk | |
| 5,493,745 | A | 2/1996 | Hauch | |
| 6,379,549 | B1 * | 4/2002 | LePoder et al. | 210/631 |
| 2001/0022286 | A1 * | 9/2001 | Hawk et al. | 210/108 |
| 2009/0120866 | A1 * | 5/2009 | Ros Roca | 210/411 |
| 2010/0101606 | A1 | 4/2010 | Grunert | |

FOREIGN PATENT DOCUMENTS

| | | |
|---|---|---|
| FR | 2791904 A1 | 10/2000 |
| GB | 1025081 | 4/1966 |

OTHER PUBLICATIONS

International Search Report PCT/EP2010/054944.
National Search Report DE 10 2009 002 540.5.

* cited by examiner

HOUSEHOLD LAUNDRY DRYER CONDENSATE FILTERING APPARATUS AND METHOD

This application is a U.S. National Phase of International Application No. PCT/EP2010/54944, filed Apr. 15, 2010, which designates the U.S. and claims priority to German Application No. 102009002540.5, filed Apr. 21, 2009, the entire contents of each are hereby incorporated by reference.

BACKGROUND OF THE INVENTION

The invention relates to a household laundry dryer, having a filter container and a method for filtering condensate water in a household laundry dryer.

Laundry dryers with a closed process air circuit are generally known, which comprise a heat exchanger coupled to the process air circuit, with the heat exchanger being used to cool down and condense warm and humid process air conducted out of a laundry drum. The heat exchanger may be an air-air heat exchanger or a heat exchanger of a heat pump for instance.

For instance, WO 2008/119611 A1 discloses a method and a washing apparatus for cleaning a component, in particular an evaporator of a heat pump, as well as a washer-dryer or tumble dryer with such an apparatus. In order to clean the component arranged within the process air circuit, condensate water, which is obtained in the process air circuit from the drying of damp laundry and is caught in a condensate water tub, is routed to a washing tub provided above the heat exchanger and released onto the component to be cleaned as a gush of water by abruptly opening onto the exit side. In particular, lint and other impurities can be cleaned off using the washing apparatus. The then heavily lint-laden water re-enters the condensate water container following the washing process. It is nevertheless disadvantageous here for the condensate water used as washing liquid to itself contain lint, which may accumulate on the component to be cleaned during the cleaning and/or washing process and decrease a cleaning effect. In order to remove lint from the condensate water container, this can be removed and emptied from the laundry dryer after a drying process. In the case of some laundry dryers, the condensate water container can be automatically pumped out into a drain.

The generic DE 1 410 851 generally relates to dry cleaning devices and to chemical cleaning methods and in particular to an improved hydraulic flow circuit for a dry cleaning device, with it being possible to implement the chemical cleaning in a programmed sequence, and with the solvent not only be constantly filtered during the cleaning process but instead also be renewed during the subsequent working periods of the program so that the hydraulic flow circuit is prepared for a newly programmed work sequence. The filter facility may comprise several porous tubes, which are arranged in a filter housing and are supported by a separation or division plate, so that the entire solvent flowing through the filter facility flows through the tubes, which consist of a conventional design and may be given a coating made of an auxiliary filter material, for instance made of diatomite so as to narrow the pores and to render more effective the filter for filtering out dirt particles with a size of 1 micron or below. An automatic backwashing of the tubes which takes place under the effect of gravity can be implemented by a large amount of completely filtered solvent, which is found above the separation plate. This thus means that the tubes are cleaner at the end of each backwashing process. Instead of the filter tubes, filters with different designs can also be used with differently formed filter surfaces for the purpose of achieving the same results. A non-generic dry cleaning device with a filter apparatus for the cleaning fluid, which has porous tubes, which are cleaned by means of a backwashing, is also known from GB 1 025 081. Nevertheless, the two cited publications are restricted to dry cleaning which is typically unsuitable for household use and its special requirements. On account of the tubes used, the filters which are needed for the very minimal pore diameter when cleaning the cleaning liquid, are therefore complex, bulky and expensive and are not suited to cleaning condensate water.

BRIEF SUMMARY OF THE INVENTION

It is the object of the invention to provide a maintenance-free option of providing clean water from contaminated water, in particular condensate water, in a household device. It may in particular be an object to provide a maintenance-free option in a laundry dryer in order to provide clean rinsing water from the lint-laden condensate water.

This object is achieved in accordance with the features of the independent claims. Preferred embodiments can be inferred in particular from the dependent claims.

The object is achieved by means of a household laundry dryer, with the household laundry dryer comprising at least one filter container, with the at least one filter container in each instance comprising at least: a chamber with an inlet for the condensate water to be cleaned, a first outlet and a second outlet and a filter element, which is arranged between the inlet and the first outlet and divides the chamber into an inlet-side first chamber part and a second chamber part, with the filter container being alignable such that the inlet is arranged below the filter element and the filter element is arranged below the first outlet and with the second outlet opening into the first chamber part.

As a result, a liquid, in particular the condensate water, which flows up, e.g. is pumped up, from the inlet through the filter element and further through the first outlet, can deposit lint or other impurities on a side of the filter element. If this liquid flow is reversed, e.g. by a pumping process being stopped and the liquid dropping downwards due to the gravity, the lint is detached from the filter element and can then be easily removed through the second outlet.

This filter container of the household laundry dryer is inter alia advantageous in that a high filter output allows for maintenance freedom without the need for manual intervention by a user. The filter container is also very simple and cheap to produce. The household device can therefore be provided easily and cheaply with water which is cleaned of water contaminated with lint or the like. Apart from facilitating operation of the device and preventing malfunctions (overflow, blockage, low cleaning output etc.), fresh water can also be saved. In addition, it is also possible to dispense with a conventional emptying of a lint deposit (separate lint deposit, condensate water tub).

The filter element may comprise a sieve, gauze, fleece etc. as a filter medium for instance. The filter element may be embodied in particular as a lint sieve. The filter element can generally comprise one or more, in particular thin, filter layers, with it being possible for each of the filter layers to comprise the sieve, the gauze, the fleece etc. The one or more filter layers may be embodied in particular as essentially flat layer(s).

It is one embodiment that the first outlet is connected to a washing facility, with the washing facility being provided in particular so as to wash one or more components of the household laundry device in order to clean them. In particular, the washing facility is provided for a flushing and thus cleaning off of a heat exchanger. In the event of the household laundry dryer comprising a heat pump, the heat exchanger may flush in particular an evaporator. Subsequently, components which are contaminated with lint can be effectively cleaned without a fresh water supply or with only a minimal fresh water supply.

It may be a further embodiment that the inlet and the first outlet open opposite one another into the chamber. As a result, a high flow speed can be achieved in the filter position. In addition, an equal backflow and thus complete detachment of lint can be achieved particularly easily. Furthermore, a particularly simple structure can thus be achieved.

For a simple connection of the filter container, the second outlet can advantageously open laterally into the chamber in respect of the inlet. As a result, a flow speed between the inlet and the second inlet can be reduced by comparison with a linear and/or opposing arrangement.

An alternative embodiment may be that the inlet and the second outlet open into the chamber opposingly. In particular, the first outlet can then be arranged laterally on the chamber in respect of the inlet.

The filter element may comprise an opening for the fluid connection of the inlet with the second outlet, said opening tightly surrounding the second outlet. For a simple and linear flow geometry, the opening can preferably be a central opening.

A further embodiment may be that the second outlet is embodied at least partially as a connecting piece, which proceeds from a chamber wall through the second chamber part to at least the opening in the filter element, with the connecting piece being sealable when the flow is through the chamber from the inlet to the first outlet (e.g. during filtering) by means of a flow element, and with the connecting piece not being completely sealable in the case of a backflow from the first outlet to the inlet by means of the flow element (e.g. in the case of a self-cleaning outlet), e.g. by lifting the flow element from the connecting piece. As a result, a self-switching valve function can be integrated into the filter apparatus, which is designed particularly easily and only needs to comprise one single moveable element for instance, e.g. the flow element. This embodiment can be easily implemented particularly in the event that the inlet and the second outlet open opposingly into the chamber.

One particular embodiment can be that the connecting piece is not able to be completely closed by means of the flow element in the case of a flow through the chamber from the inlet to the second outlet.

Advantageously the first outlet or a flow channel connected to the first outlet can comprise a larger flow cross-section than the second outlet or a flow channel which is connected to the second outlet. As a result, a passive valve function can be controlled particularly easily by means of the flow element. This valve function provides that the filter element is either passed through in the filter position or is changed into the self-cleaning position. Alternatively or in addition, the first outlet can be equipped with a reservoir for filtered water.

A particularly simple switching of the valve function into the self-cleaning position can be achieved such that the flow element does not completely close the connecting piece in the case of a flow through the chamber from the inlet to the second outlet.

The filter container of the household laundry dryer can be considered as a filter apparatus, which comprises a first outlet and a second outlet, with it being possible to feed clean water via the first outlet in a household device as liquid, in particular washing liquid, and for at least one filter element for filtering the liquid to be arranged in or on the first outlet, and for the water to be removed from the household device by way of the second outlet, with it being possible in a first position for the clean water to be pumped through the first outlet and the at least one filter element and in a first position for the water to be allowed through the first outlet and the at least one filter element in the opposite direction, and, in a second position, for the water to be removed through the second outlet.

This filter apparatus is however not dependent on the presence of the filter container. So the at least one filter element can also be used in the first outlet. The first outlet can be embodied as one piece or as a multipart outlet channel. A branch of the first outlet and of the second outlet can for instance appear on a Y-shaped branch.

The household laundry dryer can preferably comprise at least one stop valve, which is connected to at least one of the outlets of the filter container.

It may be advantageous for the household laundry dryer to comprise a pump, which is connected to the inlet of the filter container.

The inlet of the filter container is connected to a condensate water container (directly or for instance with an interconnected pump) and the first outlet is connected to a washing facility. As a result, a cleaning effect can be maintained by way of a complete drying outlet.

The object is also achieved by means of a method for filtering water in a household laundry dryer, with, in the method (a) in a filter step (i), the water to be filtered being pumped through an inlet into a chamber, (ii) then flowing through a filter element in the chamber and (iii) then emerging filtered from a first outlet; and (b) in a self-cleaning step the pumping of the water through the inlet being stopped so that at least part of the water flows back through the filter element.

It is a development that at least one component of the household laundry dryer, in particular heat exchanger, is rinsed with the filtered water emerging from the first outlet.

BRIEF DESCRIPTION OF THE DRAWINGS

In the following figures, the invention is described schematically in more detail with the aid of exemplary embodiments. Here the same or functionally-similar elements can be provided with the same reference characters for better clarity.

DETAILED DESCRIPTION OF EXEMPLARY EMBODIMENTS OF THE PRESENT INVENTION

Figure 1:
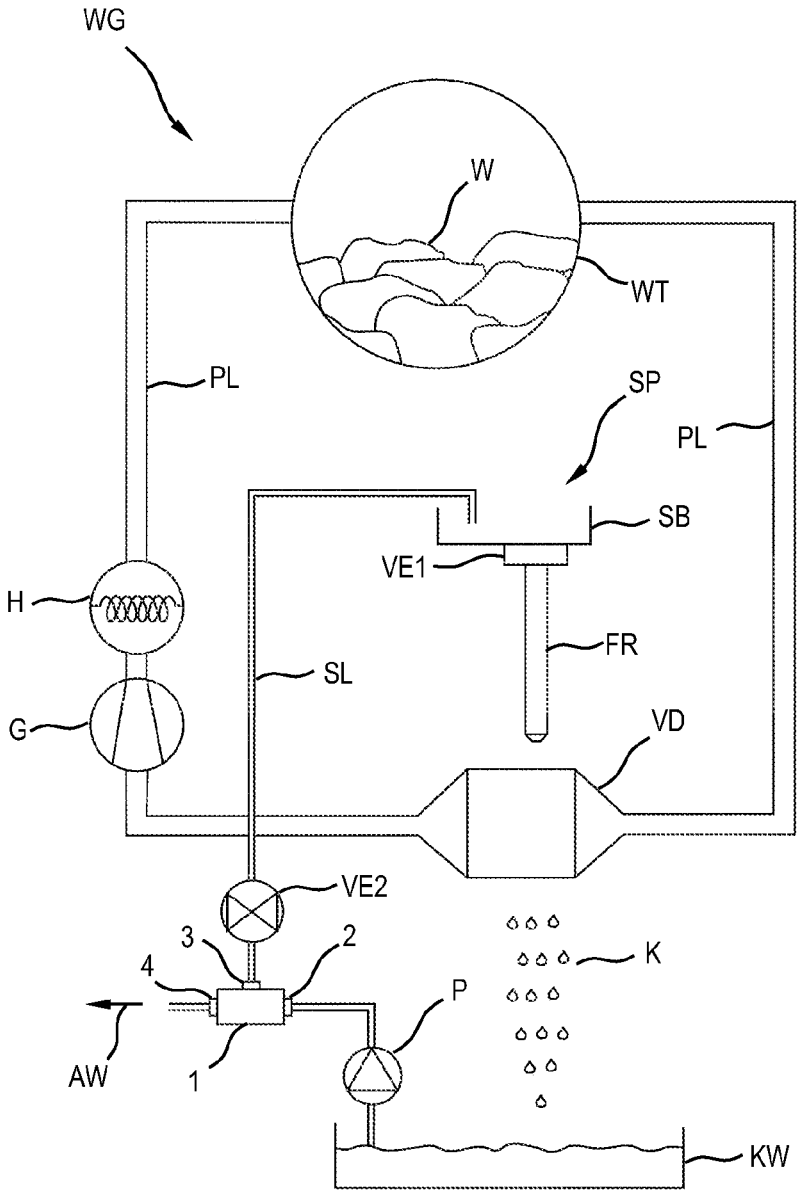
FIG. 1 shows a schematic diagram of a laundry dryer having auxiliary components of assistance for the understanding of the invention.

FIG. 1 shows a laundry dryer in the form of an exemplary tumble dryer WG. The tumble dryer WG comprises a closed process air circuit with a laundry drum WT and a process air channel PL which is connected thereto on both sides. In the laundry drum WT, warm and dry process air is passed over the laundry W, said process air therewith absorbing moisture from the laundry W. The then warm and damp process air is subsequently drawn out from the laundry drum WT through the process air channel PL to an evaporator VD of a heat pump (generally: to a heat exchanger) and is cooled down in the evaporator VD. As a result the vapor contained in the process air condenses out and drains into a condensate tub KW as condensate water K. The cooled process air behind the evaporator VD is also taken in by a fan G and then blown through a heater H. The process air is heated in the heater H and is blown back into the laundry drum WT as warm, dry air. In the laundry drum WT, in addition to absorbing the moisture from the laundry, the process air also absorbs the lint from the laundry W which partially accumulates on the evaporator VD when subsequently passing through the process air channel and reduces its degree of efficiency and partially enters the condensate water tub KW with the condensate water K.

A washing facility SP can be provided to clean the evaporator VD, it being possible, by means of a pump P, to pump up the condensate water K through a riser SL into a washing tub SB, in which it is firstly collected and if necessary is released onto the evaporator VD by opening a valve VE1 and projecting it through a downpipe. As a result, condensate water K can pass over the cooling fins in the evaporator VD at a high speed and said fins are thus entrained. Therefore the evaporator VD is to be freed of lint. The lint-laden condensate water K is then routed back into the condensate water tub KW. With conventional tumble dryers, there is the problem that a cleaning of the evaporator VD with the lint-laden condensate water K only produces a restricted cleaning effect, since lint from the condensate water K which is released from the washing tub SB can deposit again on the evaporator VD.

With the present laundry dryer WG, the lint-laden condensate water K is however pumped out of the condensate water tub KW through a filter container 1, which is used to forward the condensate water K flowing into an inlet 2 in a filter position as cleaned condensate water K through a first outlet 3 into the washing tub SB and in a self-cleaning position through a second outlet 4 with the lint detached from the filter container 1 into the sewage conduit AW. Alternatively, the second outlet 4 can lead back into the condensate water container KW. The first outlet 3 and/or the second outlet 4 can be blocked by means of respective shut-off cocks, e.g. stop valves, as shown here by way of example by means of a stop valve VE2 introduced between the first outlet 3 and the washing tub SB.

The evaporator VD can be better cleaned by using the filter container 1. The filter container 1 can be automatically actuated for instance by means of a control unit (now shown here) and/or by means of user interaction, e.g. for activating a self-cleaning function of the tumble dry WG. The structure and functionality of the filter container 1 is explained below with the aid of different embodiments. The filter container 1, the pump P, the stop valve VE2, a stop valve (not shown) to the waste water channel AW and/or the riser SL can be considered as parts of a filter apparatus.

Figure 2:
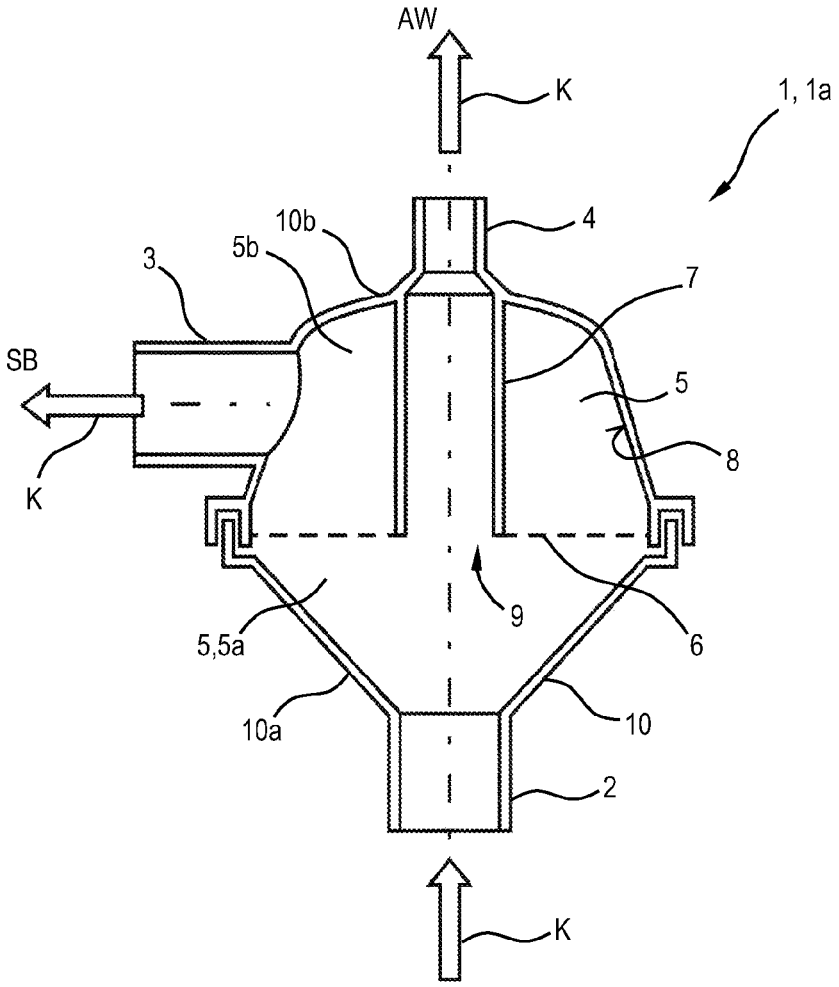
FIG. 2 shows a sectional representation of a side view of a filter container according to a first inventive embodiment.

FIG. 2 shows a filter container la according to a first embodiment, for instance for use as the filter container 1 in FIG. 1. The filter container 1*a* comprises a chamber 5, in which, in the alignment shown here, the inlet 2 opens from below. In the chamber 5, a filter element 6 is arranged in the form of a lint sieve, which divides the chamber 5 into a first chamber part 5*a* and a second chamber part 5*b*. The lint sieve here comprises a flat filter layer or sieve layer. Both the inlet 2 and also, directly opposite this, the second outlet 4, open into the first chamber part 5*a*, whereas the first outlet 3 opens into the second chamber part 5*b*. To this end, the second outlet 4 is embodied partially as a connecting piece 7, which proceeds from a chamber wall 8 of the chamber 5 through the second chamber part 5*b* to a central opening 9 in the filter element 6. The filter element 6 and the connecting piece 7 are sealed against one another, so that no parasitic flows can flow past the filter element 6. A housing 10 of the filter container 1*a* is structured here from two housing parts 10*a* and 10*b*, with the filter element 6 being inserted between the two parts 10*a* and/or 10*b*.

In the filter position, a flow channel associated with the second outlet 4 is closed, whereas a flow channel associated with the first outlet 3 is open. Such a filter position can correspond to a position in FIG. 1 in which liquid is pumped in the form of condensate water K by means of the pump P to the inlet 2 of the filter apparatus 1 and/or 1*a*, and is pumped up out of the first outlet 3 into the washing tub SB. In this position, condensate water K proceeds from the inlet 2 to the first outlet 3, namely through the filter element 6. Here lint or other floating particles are held back in the condensate water K on the inlet side of the filter element 6 and the condensate water K released through the first outlet 3 is cleaned of this lint etc.

To self-clean the filter container la, a pumping of the condensate water K up through the inlet 2 is stopped, for instance by halting the pump P shown in FIG. 1. As a result, condensate water K found in the second chamber part 5*b*, in the first outlet 3 and if necessary in a flow channel connected thereto (e.g. the riser SL from FIG. 1) flows back through the filter element 6 and further through the inlet 2. This backflow removes the lint found on the inlet side, here lower side of the filter element 6.

Subsequently the first outlet 3 is closed and the second outlet 4 is opened, and the pump operation is resumed, e.g. by once again switching on the pump P in FIG. 1. The particularly lint-laden condensate water K is now removed from the filter apparatus 1 by means of the connecting piece 7 and/or the second outlet 4, for instance into the waste water channel AW from FIG. 1.

To return to the filter position, the flow channel through the first outlet 3 is opened and the flow channel through the second outlet 4 is closed.

This filter container 1*a* is advantageous in that it manages without moveable parts and provides both an effective filter output and also a simple self-cleaning possibility by means of suitably closing and opening the outlets 3 and 4.

Figure 3:
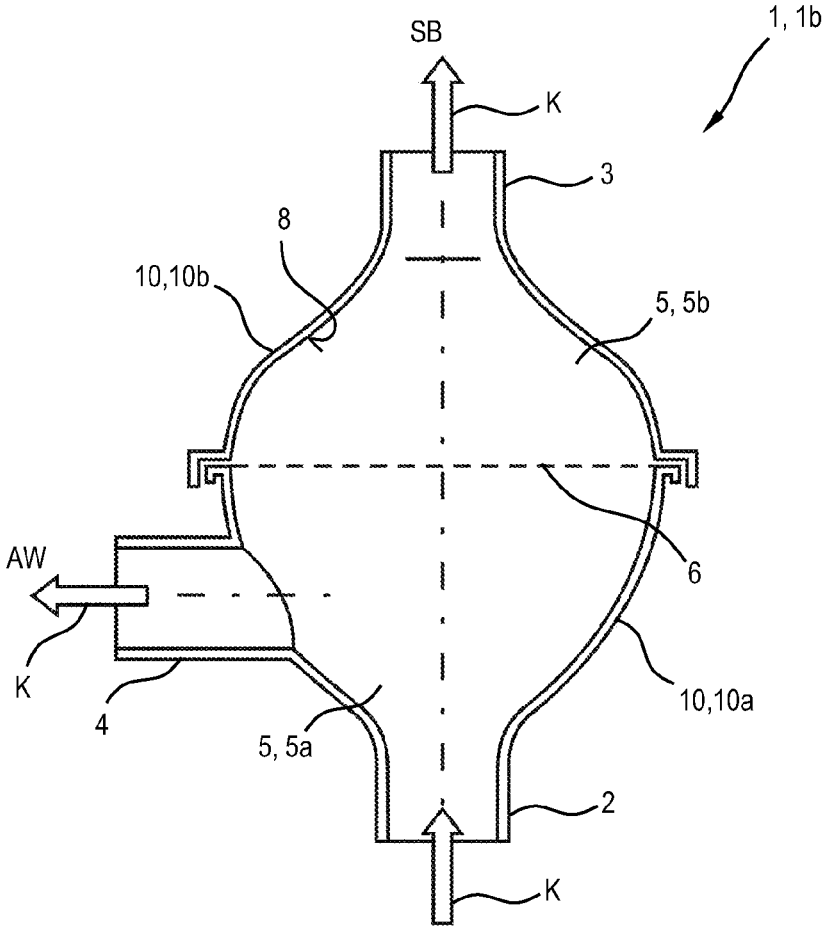
FIG. 3 shows a sectional representation of a side view of a filter container according to a second inventive embodiment.

FIG. 3 shows a filter container 1*b* according to a second embodiment, which can likewise be used as the filter apparatus 1 in FIG. 1. Unlike the embodiment in FIG. 2, the first outlet 3 now lies opposite to the inlet 2, whereas the second outlet 4 opens laterally into the first chamber part 5*a*. As a result, it is also possible to dispense with an opening in the filter element 6 and the provision of a connecting piece 7. Furthermore, it is advantageous that in the case of self-cleaning, the back-flowing condensate water K essentially flows equally through the filter element 6, whereas in the first embodiment according to FIG. 2, a flow shade is produced behind the connecting piece 7, in which lint can remain adhered to the filter element 6. The housing 10 of the filter apparatus 1*b* is also embodied in two pieces, with the filter element 6 being fastened between the two housing parts 10*a* and/or 10*b*.

Figure 4:
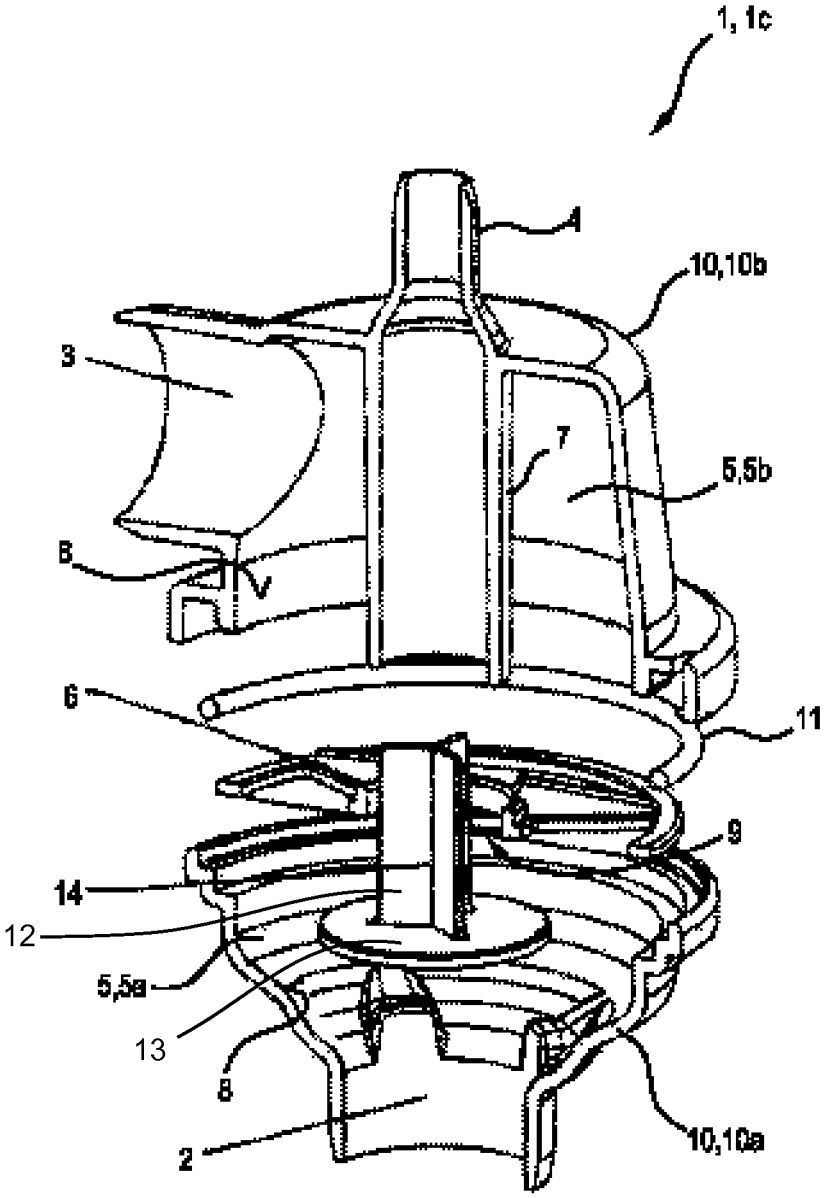
FIG. 4 shows a sectional representation of an exploded view of a filter container according to a third inventive embodiment.

FIG. 4 shows a filter container 1*c* according to a third embodiment, which can likewise be used as the filter container 1 in FIG. 1. The filter container 1*c* is a development of the basic form as shown in FIG. 2 according to the first embodiment. This view shows that the filter element 6 can be placed into the lower housing part 10*a* in order to assemble the filter container 1*c* and can be outwardly sealed with an O-shaped ring 11. For assembly purposes, the upper housing part 10*b* can then be placed onto the lower housing part 10*a* using pressure, as a result of which both the filter and element 6 and also the O-shaped ring 11 are held between the two housing parts 10*a*, 10*b*. A cross-section of the first outlet 3 amounts to approximately 20 mm, whereas a minimal cross-section of the second outlet 4 is considerably smaller, namely here by approximately 7 mm, a third thereof.

In addition to the filter apparatus 1*a* shown in FIG. 2, a flow element 12 is now arranged so as to be axially moveable at least partially in the connecting piece 7 and partially in the first chamber part 5*a*. The flow element 12 comprises a lower sealing disk 13 which lies opposite to the inlet 2, and a guide part 14 which is aligned relative to the connecting piece 7 and guided axially therein. The functionality of this filter apparatus 1*c* is described in more detail below in FIG. 5A and FIG. 5B, with FIG. 5A showing the filter apparatus 1*c* in a filter position and FIG. 5B showing the filter apparatus 1*c* in a self-cleaning position.

Figure 5A:
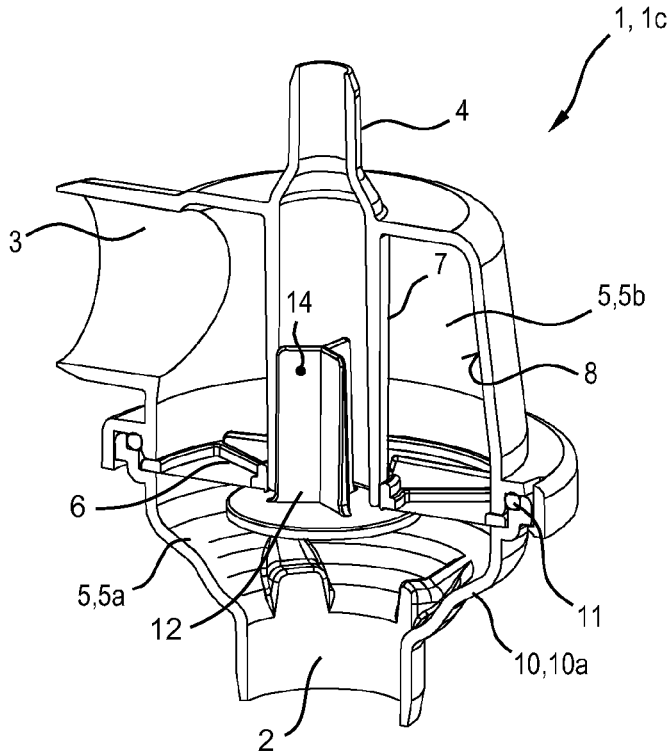
FIG. 5A shows a sectional representation of the filter apparatus according to the third inventive embodiment in a filter position.

In the filter position shown in FIG. 5A, the outlet 3 is opened (e.g. as a result of the stop valve VE2 in FIG. 1 being open), so that condensate water K pumps up through the inlet 2 into the first chamber part 5*a*, e.g. by means of the pump P. On account of the large cross-section of the first outlet 3, a high volume flow and a high flow speed develop. The flow element 12 is arranged in the flow, which is assisted by the opposing arrangement of the inlet 2 and the second outlet 4 and a minimal distance of the associated openings into the first chamber part 5*a*. With the flow conditions of the filter position in the flow direction counter to the gravity, the flow element 12 can be pushed tightly onto the connecting piece 7. As a result the second outlet 4 is blocked. The liquid in the form of condensate water K for instance flows around the flow element 12 into the second chamber part 5*b* and further through the first outlet 3 e.g. to the washing tub SB when cleaned by the filter element 6. The flow element 12 therefore forms, together with the connecting piece 7, a flow-dependent 'passive' stop valve.

Figure 5B:
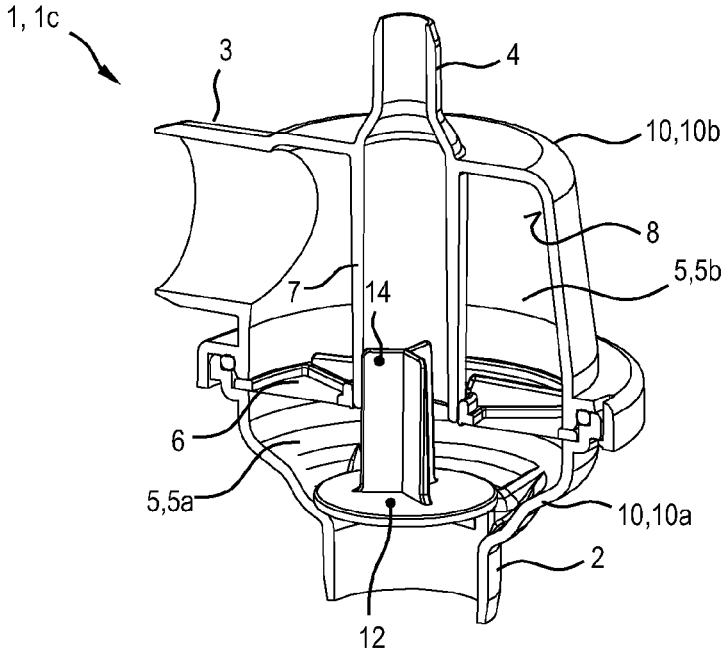
FIG. 5B shows a filter apparatus according to the third inventive embodiment in a self-cleaning position.

During the changeover to the self-cleaning position shown in FIG. 5B, condensate water K is no longer pumped into the inlet 2, e.g. by switching off the pump P. As a result, pumped-up and/or condensate water located higher than the first outlet 3 (e.g. residual liquid from liquid channels connected to the first outlet such as pipes or tubes, for instance the rising mains SL) flow back into the chamber 5 and further through the inlet 2 due to gravity. Here the impurities (lint) located on the lower side of the filter element 6 are detached from the filter element 5 and carried along. As a result of the absent upwardly directed flow of the filter position and assisted by the back flow, the flow element 12 drops due to gravity and assisted by the backflow drops downwards towards the inlet 2 and releases the connecting piece 7.

Subsequently, e.g. after a few seconds, the first outlet 3 is blocked, e.g. by closing the stop valve VE2 and condensate water K is pumped again through the inlet 2. The cross-section of the second outlet 4 is however too small, so that a flow can be structured which is sufficient to be able to press the flow element 12 tightly against the connecting piece 7. Instead, the connecting piece 7 remains open relative to the first chamber part 5*a* so that the condensate water K packed with the cleaned lint proceeds unfiltered through the second outlet 4 and can be removed, e.g. into the waste water channel AW or back into the condensate water container KW.

With this filter container 1*c*, it is therefore possible by selecting a cross-section of the respective outlets 3 and 4, a cross-section of the downstream flow channels SL (pipe, tube etc.), a flow channel length of the downstream flow channels SL and/or a delivery height to achieve a clear distinction between a volume flow in the filter position and a volume flow in the self-cleaning position. This asymmetry in the volume flows results in the moveably mounted flow element 12 closing the second outlet 4 in the filter position and not being able to close in the self-cleaning position. Such a switching characteristic can be adjusted by determining the weight of the flow element for instance.

Naturally the present invention is not restricted to the exemplary embodiments shown.

Other household devices would also like to be equipped with the filter container and/or the filter apparatus, e.g. a dishwasher, with it then being possible for the impurities to be food residues for instance.

Closure of an outlet and/or an associated flow channel can be implemented by means of at least one valve. Here the at least one valve may be part of the filter container and/or can be a part of the filter apparatus when connected to the filter container. The outlets and/or the associated flow channels can be closed individually or by means of one or a number of shared valves.

Generally the first outlet can be used to provide a liquid, which may in particular be washing liquid. Here it is also possible to dispense with a washing tub for instance.

The outlets are not restricted to a right-angled arrangement, but can instead also lead into the chamber at other suitable angles relative to one another.

LIST OF REFERENCE CHARACTERS

1 Filter apparatus
1*a* Filter apparatus
1*b* Filter apparatus
1*c* Filter apparatus
2 Inlet
3 First outlet
4 Second outlet
5 Chamber
5*a* First chamber part
5*b* Second chamber part
6 Filter element
7 Connecting piece
8 Chamber wall
9 Opening in the filter element
10 Housing
10*a* Housing part
10*b* Housing part
11 O-ring
12 low element
13 Sealing disk
14 Guide
AW Waste water channel
FR Down pipe
G Fan
H Heater
K Condensate water
KW Condensate water tub
P Pump
PL Process air channel
SL Riser
SP Washing apparatus
SB Washing tub
VD Evaporator
VE1 Valve
VE2 Stop valve W Laundry
WG Laundry dryer
WT Laundry drum

The invention claimed is:

1. A household laundry dryer, comprising at least one filter container, said at least one filter container comprising:

a chamber having an inlet for condensate water to be cleaned, a first outlet, and a second outlet, and a filter element arranged between the inlet and the first outlet and dividing the chamber into an inlet side first chamber part and a second chamber part, wherein the inlet of the chamber is arranged below the filter element and the filter element is arranged below the first outlet, wherein the second outlet opens into the first chamber part, wherein particles deposited on the filter element by water being pushed through the inlet into the chamber are detachable from the filter element by water flowing back into the chamber on conclusion of the pushing through, and removable through the second outlet, wherein the inlet and the second outlet also open opposite one another into the chamber, and the first outlet is arranged laterally on the chamber in respect of the inlet.

2. The household laundry dryer of claim 1, further comprising a washing facility, said first outlet connected with the washing facility.

3. The household laundry dryer of claim 2, wherein the washing facility is adapted for flushing a heat exchanger.

4. The household laundry dryer of claim 1, wherein the filter element comprises an opening which seals tightly around the second outlet.

5. The household laundry dryer of claim 4, wherein the opening is provided in midsection of the filter element.

6. The household laundry dryer of claim 4, wherein the second outlet is embodied at least partially as a connecting piece, which runs from a chamber wall through the second chamber part to at least the opening in the filter element, and further comprising a flow element adapted to seal the connecting piece during a flow through the chamber from the inlet to the first outlet, while not completely sealing the connecting piece during a backflow from the first outlet to the inlet.

7. The household laundry dryer of claim 6, wherein the connecting piece is not completely sealed by the flow element during flow through the chamber from the inlet to the second outlet.

8. The household laundry dryer of claim 1, wherein the first outlet or a flow channel connected to the first outlet is defined by a flow cross-section which is larger than a flow cross-section of the second outlet or a flow channel connected to the second outlet.

9. The household laundry dryer of claim 1, wherein the filter element includes a lint sieve.

10. The household laundry dryer of claim 1, further comprising a condensate water container, said inlet of the at least one filter container being connected to the condensate water container.

11. The household laundry dryer of claim 1, wherein the inlet is located centrally on a side of the first chamber part.

12. The household laundry dryer of claim 11, wherein the side is a bottom side.

13. The household laundry dryer of claim 1, wherein the inlet is located below the second outlet.

14. The household laundry dryer of claim 1, further comprising an outlet member, the outlet member comprising the second outlet, a third outlet and a flow passage connecting the second outlet to the third outlet, wherein the flow passage passes through a wall of the second chamber part.

15. The household laundry dryer of claim 1, further comprising a laundry drum and a process air channel.

16. A method for filtering water in a household laundry dryer by at least one filter container, wherein the at least one filter container at least comprises a chamber having an inlet for condensate water to be cleaned, a first outlet, and a second outlet, and a filter element arranged between the inlet and the first outlet and dividing the chamber into an inlet side first chamber part and a second chamber part, wherein the inlet of the chamber is arranged below the filter element and the filter element is arranged below the first outlet, wherein the second outlet opens into the first chamber part, wherein particles deposited on the filter element by water being pushed through the inlet into the chamber are detachable from the filter element by water flowing back into the chamber on conclusion of the pushing through, and removable through the second outlet, wherein the inlet and the second outlet also open opposite one another into the chamber, and the first outlet is arranged laterally on the chamber in respect of the inlet, said method comprising:

a filter step which comprises pumping water to be filtered through the inlet into the chamber, having the water flow through the filter element in the chamber, thereby holding back particles to be filtered on the filter element, and discharging the water through the first outlet as filtered water, and a self-cleaning step which comprises stopping a pushing of the water through the inlet to allow at least one part of the water to flow back through the filter element and thereby detach held-back particles from the filter element and remove them through a second outlet.

17. The method of claim 16, wherein the stoppage of the pushing step includes a stoppage of the pumping step.

18. The method of claim 16, further comprising rinsing at least one component of the household laundry dryer with the filtered water discharged through the first outlet.

19. The method of claim 18, wherein the component of the household laundry dryer is a heat exchanger.

20. The method of claim 16, wherein the inlet is located centrally on a side of the first chamber part.

21. The method of claim 20, wherein the side is a bottom side.

22. The method of claim 16, wherein the inlet is located below the second outlet.

23. The method of claim 16, wherein:

the household laundry dryer further comprises an outlet member, the outlet member comprises the second outlet, a third outlet and a flow passage connecting the second outlet to the third outlet, and the flow passage passes through a wall of the second chamber part.

24. The method of claim 16, wherein the household laundry dryer further comprises a laundry drum and a process air channel.

25. A method of operating a household laundry dryer between a filter position in which water is being filtered and a self-cleaning position, wherein in the filter position water to be filtered is pumped into a chamber of a filter container to traverse a filter element in the chamber to thereby hold back particles contained in the water, and is then discharged as filtered water through a first outlet of the filter container, and wherein in the self-cleaning position water is allowed to flow back from an area in the chamber above the filter element through the filter element by stopping a flow of water through the inlet to thereby flush particles held back during filtering by the filter element through a second outlet of the filter container.

26. The method of claim 25, wherein the self cleaning position occurs when water is not being pumped into the chamber.

27. The method of claim 25, wherein in the self cleaning position, the water flow occurs due to gravity.

28. The method of claim 25, wherein the household laundry dryer further comprises a laundry drum and a process air channel.

* * * * *